United States Patent [19]

Boxerman et al.

[11] 4,265,485

[45] May 5, 1981

[54] THERMAL-MINE OIL PRODUCTION METHOD

[76] Inventors: Arkady A. Boxerman, 1 Dmitrovsky proezd, 8, kv. 29; Nikolai S. Kuvshinov, ulitsa akademika Millionschikova, 11, kv. 192; Naftula L. Rakovsky, Vorobievskoe shosse, 11, kv. 31; Vladimir P. Tabakov, ulitsa Sofii Kovalevskoi, 4a, kv. 125; Lev D. Churilov, Yasenevo, 2 mikroraion, korpus 3a, kv. 685, all of Moscow; Ostap O. Sheremeta, ulitsa Mira, 1, kv. 43, Komi ASSR, Ukhta; Viktor P. Pilatovsky, 1 Dmitrovsky proezd, 8, kv. 137, Moscow; Evgeny I. Gurov, poselok Yarega, ulitsa Mira, 2, kv. 3, Komi ASSR, Ukhta; Pavel G. Voronin, poselok Yarega, ulitsa Mira, 4, kv. 6, Komi ASSR, Ukhta; Alexandr I. Obrezkov, ulitsa Oplesnina, 30, kv. 35, Komi ASSR, Ukhta; Vitaly S. Sukrushev, poselok Yarega, ulitsa Neftyanikov, 1, kv. 14, Komi ASSR, Ukhta; Vitaly S. Zubkov, poselok Yarega, ulitsa Mira, 2, kv. 12, Komi ASSR, Ukhta; Valery M. Tutarinov, poselok Yarega, ulitsa Mira, 4, kv. 3, Komi ASSR, Ukhta; Vladimir N. Mishakov, poselok Yarega, ulitsa Neftyanikov, 1, kv. 25, Komi ASSR, Ukhta; Grigory G. Miller, ulitsa Pushkinskaya, 1, kv. 4, Komi ASSR, Ukhta; Leonid M. Ruzin, poselok Yarega, ulitsa Kosmonavtov, 4, kv. 59, Komi ASSR, Ukhta; Vladimir N. Judin, poselok Yarega, ulitsa Kosmonavtov, 5, kv. 26, Komi ASSR, Ukhta, all of U.S.S.R.

[21] Appl. No.: 4,274

[22] Filed: Jan. 14, 1979

[51] Int. Cl.[3] ..... E21B 43/24; E21C 41/10

[52] U.S. Cl. ..... 299/2; 166/272; 166/303

[58] Field of Search ..... 166/272, 302, 303; 299/2

[56] References Cited

U.S. PATENT DOCUMENTS

| | | | |
|---|---|---|---|
| 1,520,737 | 12/1924 | Wright | 166/50 X |
| 1,735,481 | 11/1929 | Uren | 299/2 |
| 1,811,560 | 6/1931 | Ranney | 299/2 |
| 1,811,561 | 6/1931 | Ranney | 299/2 |
| 2,210,582 | 8/1940 | Grosse et al. | 299/2 |
| 2,670,802 | 3/1954 | Ackley | 166/272 |
| 3,425,492 | 2/1969 | Gilchrist | 166/272 |
| 3,439,743 | 4/1969 | Wyllie | 166/272 |
| 4,099,783 | 7/1978 | Verty et al. | 299/2 |
| 4,101,172 | 7/1978 | Rabbitts | 299/2 |
| 4,165,903 | 8/1979 | Cobbs | 299/2 |

OTHER PUBLICATIONS

Ranney, "The First Horizontal Oil Well", *The Petroleum Engineer,* Jun., 1939, pp. 25–30.

*Primary Examiner*—James A. Leppink
*Assistant Examiner*—George A. Suchfield
*Attorney, Agent, or Firm*—Steinberg & Raskin

[57] ABSTRACT

The method of thermal-mine oil production includes provision of a system of mine workings and at least one operation gallery, drilling production wells from the gallery into the upper and lower portions of the oil-bearing bed, drilling from the gallery injection wells into the central portion of the oil-bearing bed, positively injecting a heat carrier through said injection and production wells into the oil bearing bed to heat the latter to a temperature at which the oil attains the required fluidity within the oil bearing bed, positively feeding a heat carrier via the injection wells into the central portion of the oil-bearing bed for uniform distribution of the heat carrier throughout the body of the oil-bearing bed and forcing oil therefrom into the said production wells. The method further includes collecting the oil from the upper and lower portions of the oil-bearing bed through the said production wells in the operation gallery and directing the oil from the operation gallery through the mine workings to the ground surface.

14 Claims, 14 Drawing Figures

THERMAL-MINE OIL PRODUCTION METHOD

The present invention relates to the field of developing oil-bearing areas by the method wherein mines are used, and, more particularly, it relates to the thermal-mine oil production method.

The invention can be used to utmost effectiveness in the development of oil fields with highly viscous crude oil grades and movable or fluent bitumens.

The invention also can be utilized for producing oil from exhausted fields.

At present, such fields as those mentioned above cannot, as a rule, be developed by the traditional oil production methods wherein wells are drilled into the oil-bearing strata from the ground surface. The yield obtainable by such methods is inadequate.

To develop fields with highly viscous or heavy oils and fluent bitumens, there is known a mine method of oil production without bringing the oil-saturated earth or rock to the ground surface (see, for example, "Mine Development of Oil Fields" by A. J. Krems et al., in Russian, Gostoptechizdat Publishers, Moscow, 1955). The method includes providing mine workings some 10 to 30 meters above the roof of the oil-bearing bed. Then the mining field is subdivided into a plurality of lots. Over the area of these lots fringe drifts with drilling chambers are provided. From these chambers holes are drilled in accordance with a preselected pattern into the oil-bearing bed, the holes being vertical and inclined. The depth of these holes or wells is determined by the thickness of the oil-bearing bed.

The spacing of the bottoms of the wells, the quantity of the wells and the pattern of driving the mine workings can be vary considerably when the above specified method is realized.

The well bottoms are uniformly distributed over the bottom of the bed.

The structure of the well is such that the well is provided with a casing column lowered to the roof of the oil-bearing bed, leaving the bottom of the well open, i.e. not enclosed in the casing.

When the wells are drilled, oil is produced therefrom, first, by the flow method and then by the air lift method.

During the flow stage of the oil production, oil rises through the wells into the drilling chamber under the internal pressure within the oil-bearing bed.

During the air-lift stage, the oil is driven through the wells into the drilling chambers by supplying compressed air to the well bottoms via additional pipes.

Oil from the wells flows into grooves provided in the mine workings. Jointly with water fed into these grooves, oil is conveyed toward units where it is separated from the main mass of water. From these units oil is pumped into central underground oil reservoirs; then, following the pretreatment and heating, oil is pumped into reservoirs on the ground surface.

When the above described method is performed, the yield of highly viscous or heavy oil grades is relatively low.

Furthermore, the realization of this method involves the necessity of performing a great volume of labour-consuming and costly mining and drilling work in barren rock bearing no oil.

Furthermore, the great number of operating wells and their arrangement in underground mine workings impair the performance of repair and maintenance work and the use of various additional techniques, such as acid treatment of the bed, hydraulic fracturing, etc.

There is also known a thermal-mine oil production method by exerting the heat-steam action upon the oil-bearing bed (see, for example, "Experience Of Using Thermal Methods At Mine Development of Highly Viscous Oil Fields" by V. N. Mishakov et al. in "Nyeftyanoye Khozyaistvo"/"Oil Industry"/magazine, No 10, 1974).

This method provides a system of mine workings above the oil-bearing bed.

Vertical and inclined boreholes are drilled from these workings, some of these boreholes or wells being used for feeding a heat carrier (steam) into the oil-bearing bed—the injection wells—and the rest of the wells being used for producing oil from the bed—the production wells.

Oil is forced by the heat carrier, e.g. steam, from the bottoms of the injection wells toward the bottoms of the production wells. From the bottoms of these production wells the oil is raised into the underground mine workings by the air lift method.

When the volume of the production is being increased, the number of the underground wells becomes great. The maintenance and repair work is impaired by the conditions of the thermal action upon the bed. More often than not sand plugs form in the production wells operated by the air lift method, i.e. the wells become clogged with sand carried from the fed.

Besides, to perform the air lift method of oil production, the wells are to be additionally equipped with specific pipes or tuing and with valve means for closing off the air feed, whenever necessary; to say nothing of the considerable amounts of compressed air required to feed the liquid through the wells.

To complete the picture, when the injection pressure is as high as 10 to 20 kgf/cm$^2$ or higher there is a possibility that the steam being supplied finds its way through cracks and fissures into the mine workings above the bed; another eventuality is caving-in of the workings.

With the wells are spaced relatively closely, the continuous injection of steam becomes impractical.

The interruptions in the operation of the injection and production wells lead to sand plugs forming, to the operating of the wells being complicated, to affected production of the hot oil by the air lift method, which adds up to the relatively low yield of the oil-bearing bed.

In another known method of mine production of oil (see the U.S. Pat. No. 1,634,235), wells are drilled from underground mine workings provided below the oil-bearing bed, and oil is collected from relatively shallow wells drilled in upward direction. In this case the mine workings are driven radially from the central mine shaft, over the area of the mining field.

This method is based on the oil being produced from the bed by a gravity flow, the heating of the area of the bed adjoining the well face or bottom being effected by feeding steam to the well bottoms through tubes accommodated in the wells.

A disadvantage of this method is the non-uniformity of the arrangement of the mine workings and wells over the area of the mining field. The portions of the mining field adjoining the mine shaft are thus developed with a dense network of wells, while those areas which are remote from the shaft are developed with a far less dense network of wells. Such arrangement of the wells results in uneven exploitation of the oil reserves.

There is further known a mine oil production method (see the U.S. Pat. No. 1,520,737) including providing a vertical mine shaft intersecting the oil-bearing bed and providing a drilling chamber below this bed, whereafter inclined rising wells are drilled radially from the drilling chamber into the oil-bearing bed.

Through these wells a heat carrier, e.g. steam, is supplied via tubes of a smaller diameter than that of the wells. The heated oil flows into the drilling chamber wherefrom it is pumped to the ground surface.

Notwithstanding the simplified process of oil production and the increased yield of the bed, offered by the last-described method, the development is confined to the area of the bed, limited by the possibilities of drilling inclined wells, i.e. by the length of the wells. Thus, an individual mine shaft is to be sunk from the ground surface for a limited area of the bed, which fact significantly affects the economy of this oil production method.

There is still further known a thermal-mine method of oil production (see the SU Inventors' Certificate No. 446,631) including providing two levels of mine workings, i.e. mine workings above the oil-bearing bed and a production gallery in the lower portion of the oil-bearing bed.

From the mine workings above the oil-bearing bed injection wells for injecting a heat carrier into the bed are drilled. From the production gallery there are drilled gently sloping rising wells for the production of oil. When oil is being collected through these sloping rising wells, the mine working in the oil-bearing bed is filled with water, pumps being used to maintain a permanent water level in the mine working.

A drawback of this method arises from considerable heat losses through the roof and bottom of the oil-bearing bed, since the heat carrier is supplied through the injection wells over the entire thickness of the oil-bearing bed.

Considerable heat losses also take place through the walls of the injection wells within the barren rock bearing no oil, extending between the roof of the oil-bearing bed and the mine working from which the injection wells have been drilled.

The drilling of the injection wells through barren rock more often than not accounts for more than one half of the total amount of the work of drilling the injection wells, which affects the efficiency of this oil production method.

Under some geological conditions it is practically impossible to provide mine workings either above the oil-bearing bed or substantially within the upper portion of the oil-bearing bed, which makes the last-described method unperformable.

It is an object of the present invention to provide a versatile method of thermal-mine oil production, which is performable under most diverse geological conditions.

It is another object of the present invention to provide a method of thermal-mine oil production, which steps up the efficiency of the oil production process.

It is still another object of the present invention to provide a method of thermal-mine oil production, which simplifies the operating of the wells.

These and other objects are attained in a method of thermal-mine oil production, including:

providing a system of underground mine workings and at least one operation gallery;

drilling production wells from said operation gallery into the upper and lower portions of an oil-bearing bed;

drilling injection wells from this operation gallery into the central portion of the oil-bearing bed;

positively injecting a heat carrier through said injection and production wells into the oil-bearing bed to heat it up to a temperature at which the oil attains the required fluidity within the oil-bearing bed;

positively injecting the heat carrier through said injection wells into the central portion of the bed, for uniform distribution of the heat carrier throughout the volume of the oil-bearing bed and for forcing the oil into said production wells;

collecting the oil from the upper and lower portions of the oil-bearing bed through said production wells in the operation gallery; and directing the oil from said operation gallery via the mine workings to the ground surface.

The major improvement proposed by the method in accordance with the present invention consists in that the heat carrier is introduced into the central portion of the bed, while the oil is collected from the upper and lower portions of the bed.

The increased oil yield of the bed is attained, owing to the heating of the oil-bearing bed and of the oil saturating it, and, hence, owing to the reduced viscosity of the oil, the thermal expansion of the oil and the increased pressure within the bed.

The increased efficiency and effectiveness of the heating process is attained, owing to the heat carrier being introduced into the central portion of the bed and the oil being collected from the upper (roof-adjoining) and lower (bottom-adjoining) portions of the oil-bearing bed, and, hence, owing to the reduced heat losses through the roof and bottom of the bed, and also owing to the practically complete elimination of the heat losses through the walls of the injection wells, the latter being drilled within the oil-bearing bed itself.

The increased efficiency of the oil production process is attained, due to the increased yield of the bed, to the increased rate of the development of the oil deposits, and to the elimination of the drilling of the wells through barren rock bearing no oil, this elimination being either complete, or at least substantial.

The method of the present invention provides for the maximum possible degree of draining of the bed with gently sloping and horizontal wells which, while extending through the oil-bearing bed over dozens and hundreds of meters, interconnect its non-uniform zones, as well as various inherent ducts, fissures, caves, and thus step up the degree of the opening of the oil-bearing bed.

The method further provides, in addition to of the process of forcing out the oil, for gravity flow of the oil, with the mode of operating the wells being significantly simplified.

It is expedient that in oil-bearing beds of medium thickness, including good rock, there should be provided three operation galleries, two being substantially accommodated within the lower and upper portions of the bed, respectively, from which galleries substantially horizontal production wells are drilled, and the third gallery being accommodated in the central portion of the oil-bearing bed, from which gallery horizontal injection wells are drilled.

This permits minimizing and even complete elimination of drilling through barren rock bearing no oil.

It is also expedient in cases when the upper portion of the oil-bearing bed includes incoherent and loose rock, and there are under the oil-bearing bed strata with high-pressure stratum water and insecure rock, to provide two operation galleries, one being accommodated in the central portion of the bed, from which gallery rising production wells and substantially horizontal injection wells are drilled, and the other gallery being accommodated substantially within the lower portion of the bed, from which gallery substantially horizontal production wells are drilled.

In this way the volume of the mining work in the oil-bearing bed is reduced, with two operation galleries being provided instead of three.

It is likewise expedient in cases of oil-bearing beds of which the upper portion includes incoherent and loose rock, while the central and lower portions of the bed and the underlying strata include secure good rock, to provide two operation galleries, of which one is accommodated in the central portion of the bed, and from which gallery rising production wells and substantially horizontal injection wells are drilled, the other operation gallery being provided below the oil-bearing bed, from which gallery rising production wells are drilled.

In this case all the production wells are operable with a gravity flow, which simplifies the oil production. The gravity flow also enhances the well operation conditions.

The provision of the lower operation gallery and subsequent work therein of the operators are facilitated, because this lower operation gallery is accommodated outside the oil-bearing bed.

It is also expedient in cases where good rock is available both above and below the oil-bearing bed, as well as when harder rock is available in the upper portion of the oil-bearing bed than in the lower portion thereof, to provide two operation galleries of which one is accomodated above the oil-bearing bed, from which gallery inclined injection and production wells are drilled, the other gallery being below the oil-bearing bed, from which gallery rising production wells are drilled.

It is also expedient in cases where harder rock is available in the lower portion of the oil-bearing bed than in the upper portion thereof, and also where good rock is available both above and below the oil-bearing bed, to provide two operation galleries of which one is accommodated above the oil-bearing bed, from which gallery inclined production wells are drilled, the other gallery being accommodated below the oil-bearing bed, from which gallery rising production and injection wells are drilled.

The choice of the operation gallery for the accommodation of the injection wells in the two above described types of cases is defined by the conditions enhancing the drilling of the injection wells and of ensuring dependable ventilation or airing of the mine workings where people work, as well as by the actual geological conditions.

In this way it is possible to comply with the existing labour and safety regulations.

It is a further expedient in case of an oil-bearing bed of a relatively small thickness, including good rock, to provide a single operation gallery in the central portion of the bed and to drill therefrom substantially horizontal injection wells and inclined and rising production wells. This pemits reduction of the volume of the mining work within the oil-bearing bed.

It is still a further expedient in cases where the central and lower portions of the oil-bearing bed include incoherent and loose rock, to provide a single operation gallery substantially within the upper portion of the oil-bearing bed and to drill therefrom inclined injection wells and inclined and substantially horizontal production wells.

It is expedient in cases where the entire oil-bearing bed includes incoherent and loose rock, and below the oil-bearing bed or in the lower portion thereof there is either high-pressure stratum water or incoherent and loose rock, while good rock is available above the oil-bearing bed, to provide a single operation gallery above the oil-bearing bed and to drill therefrom inclined production and injection wells.

It is also expedient in cases where the central and upper portions of the oil-bearing bed include incoherent and loose rock, and the mining work above the oil-bearing bed is complicated, to provide a single operation gallery substantially in the lower portion of the oil-bearing bed and to drill therefrom rising injection wells and rising and substantially horizontal production wells.

It is a further expedient in cases where both the oil-bearing bed and the rock thereabove would not provide for driving mine workings therein, to provide the operation gallery below the oil-bearing bed and to drill therefrom rising production and injection wells.

It is also expedient that an oil-bearing bed of a relatively great thickness should be subdivided into a plurality of levels layer-wise of the bed, with the production wells being drilled into the upper and lower portions of each level, and the injection wells being drilled into the central portion thereof.

This provides for intensifying the oil production process by speeding up the development and increasing the yield of the bed by having a denser network of the production and injection wells.

It is a still further expedient, following the heating up of the non-uniform oil-bearing beds, to use air for the oil-forcing medium positively injected into the bed, the feed of the air being alternated with the feed of hot water and steam.

This provides for enhancing the efficiency of the thermal action upon the oil-bearing bed. The increased efficiency of the process of the thermal-mine oil production is attained by replacing that part of the heat carrier, e.g. steam, which is used solely for forcing oil out of the oil-bearing bed, with a cheaper agent, i.e. air. Only that amount of the heat carrier, e.g. hot water or steam, is fed into the bed, which is sufficient for maintaining the bed temperature at the level required by the production conditions.

While entering the heated up bed, the air expands, which creates an additional pressure drop across the bed, enhancing the motion of the oil toward the production wells. The first to be forced out of the saturated bed is the oil filling large fissures, caverns and pores. The hot water subsequently pumped into the oil-bearing bed forces out the oil from smaller pores and microfissures, owing to capillary impregnation.

It is likewise expedient that, following the heating up of a non-uniform oil-bearing bed, water-air mixture should be used as the medium positively fed through the injection wells into the bed, the feed of the mixture being alternated with the feed of steam. This enhances the efficiency of the thermal action upon the bed.

The quantity of the heat carrier, e.g. steam, is determined from the actual production conditions enabling increase of the bed temperature and maintaining it at the required level.

By replacing that part of the heat carrier which was formerly used solely to force out oil from the oil-bearing bed with a cheaper agent, i.e. air, the efficiency of the process of thermal-mine oil production is increased, with less heat carrier being consumed per volume unit of the produced oil.

The water-air mixture expands, while entering the heated up bed, creating an additional pressure drop across the bed, which enhances the motion of oil in the oil-bearing bed from the injection wells towards the production ones.

Owing to this pressure drop, the saturating oil is forced out from large pores, caverns and fissures. Owing to the impregnation of the oil-bearing bed with the water included into the water-oil mixture, oil is forced out from smaller pores and microfissures, the two processes taking place at the same time.

The present invention will be further described in connection with embodiments thereof, with reference being had to the accompanying drawings, wherein.

Figure 1:
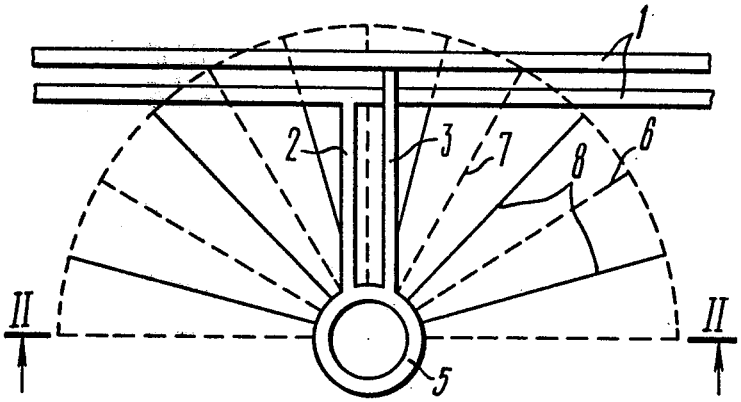
FIG. 1 shows an area of mine workings with horizontal injection and production wells extending radially in the bed, in the plane of the bed (the mine workings are symbolically combined within a single horizontal plan)

The disclosed method is effected, as follows.

There is provided a system of mine workings including drifts 1 (FIG. 1), an incline 2, a foot way 3, as well as shafts and shaft-adjoining workings (not shown). The drifts 1 are driven above the roof of the oil-bearing bed 4 (FIG. 2) and are inclined at 1°–3° relative to a horizontal plane. Then the inclined workings are provided, viz, the incline 2 (FIG. 1) and the foot way 3 leading to the area of the oil-bearing bed 4 (FIG. 2) wherein at least one operation gallery 5 is provided.

Figure 2:
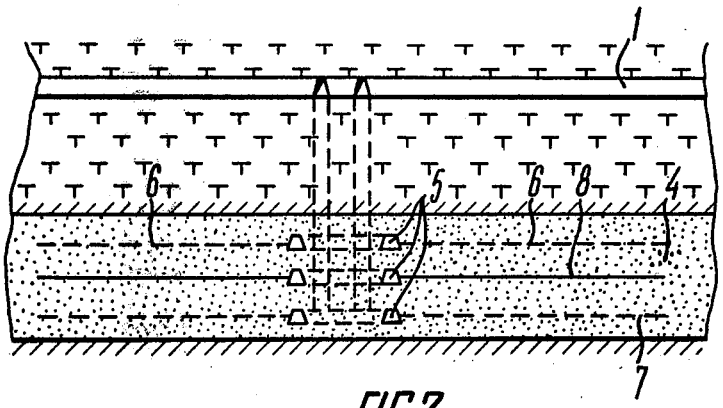
FIG. 2 is a sectional view taken on line II—II of FIG. 1.

Three operation galleries 5 are shown in FIG. 2, which does not limit the scope of the invention. Two of them are accommodated substantially within the upper and lower portions of the oil-bearing bed 4, wherefrom substantially horizontal operation wells 6 and 7 are drilled, while the third operation gallery 5 is accommodated in the central portion of the oil-bearing bed 4, and substantially horizontal injection wells 8 are drilled therefrom.

Figure 3:
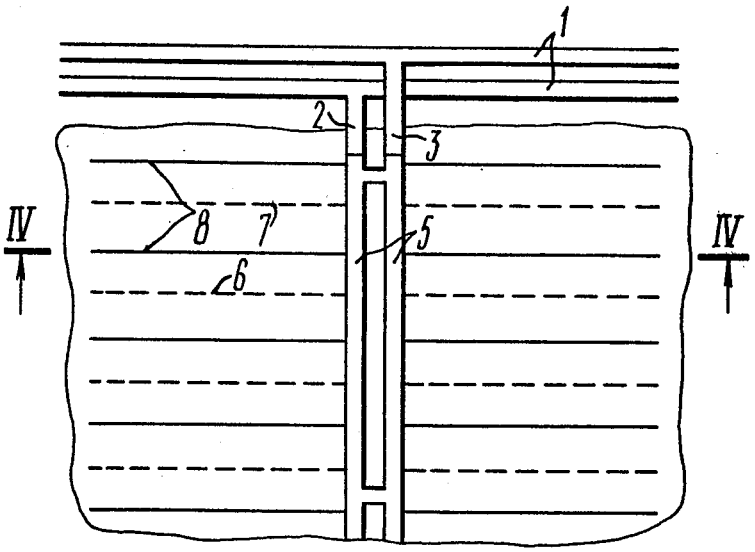
FIG. 3 shows an area of mine workings with horizontal injection and production wells extending parallel to one another, in the plane of the bed (the mine workings are symbolically combined within a single horizontal plane)
Figure 4:
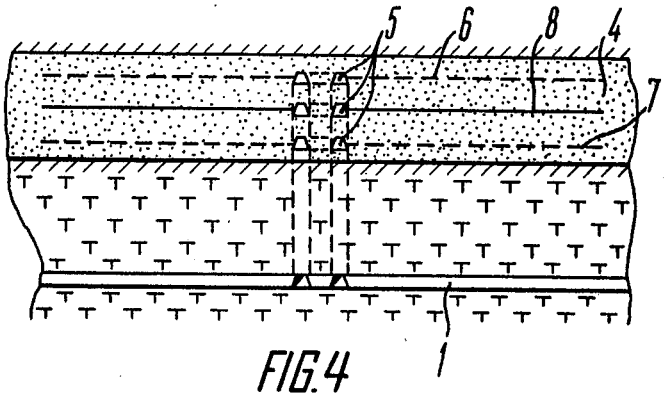
FIG. 4 is a sectional view taken on line IV—IV of FIG. 3.

An operation gallery 5 may have various shapes, viz. circular (as shown in FIG. 1), square, rectagonal, elliptical, rectilinear (as shown in FIG. 3), curvilinear, etc.

The production wells 6, 7 (FIG. 1) and the injection ones 8, in the case of the circular operation gallery 5 are drilled uniformly over the covered area along the radii of a circle. In the case of the rectilinear gallery 5 (FIG. 3) the said wells 6, 7 and 8 are drilled to cover uniformly the area, parallel to one another.

Using the system of the production and injection wells 6, 7 and 8, respectively, the oil-bearing bed is heated by any suitable known method practiced in the thermal-mine oil production to a temperature at which the oil attains the required fluidity within the oil-bearing bed.

For various oil fields this temperature may vary considerably, e.g. within a range from about 80° C. to 250° C. and is determined by the properties of the oil.

As an outcome of the dense network of the production and injection wells 6, 7 and 8, respectively, extending over considerable distances along the oil bed 4, the latter is heated up quickly and uniformly throughout its volume.

In highly permeable and fissured beds of medium and small thickness, the heating up of the bed 4 is effected by supplying the heat carrier, e.g. steam, solely via the injection wells 8, with the presence of the fissures in the bed 4 enhancing its heating-up. With the temperature of the oil-bearing bed 4 rising, the viscosity of the oil lowers and its fluidity is improved.

The introduction of the heat carrier into the central portion of the bed 4 via the injection wells 8 and the collection of the oil therefrom from the upper (roof-adjoining) and lower (bottom-adjoining) portions thereof via the production wells 6 and 7 enhance the efficiency of the heating up of the bed 4 by reducing the heat losses through the roof and bottom of the bed 4, and also owing to the absence of heat losses through the walls of the wells which in the presently described case are not drilled through barren rock containing no oil, but are drilled completely within the oil-bearing bed.

With the above discussed temperature attained, the heat carrier, e.g. steam, hot water, hot air, etc., is positively fed or injected into the central portion of the bed 4 via the injection wells 8, and oil is collected via the production wells 6 and 7.

The pressure drop across the injection wells 8 and the production wells 6 and 7, the capillary impregnation and the weight of oil enhance the forcing out of the oil from the rock blocks of the bed 4 into fissures, and from the fissures into the production wells 6 and 7.

The great area of the opening-up of the bed 4 with the production wells 6 and 7 and the injection wells 8, jointly with the above discussed factors permits reduction of the filtration resistance to the motion of the oil within the bed 4.

With the production wells 6 and 7 and the injection wells 8 (FIG. 3) running parallel to one another, there are created better conditions of draining the bed 4, as compared with the radial arrangement of the wells 6, 7 and 8 (FIG. 1), since in the first-described case the bed 4 is more uniformly covered with the network of the wells.

The greater number of the injection wells 8, the bigger area of the opening-up of the oil-bearing bed with these injection wells 8 remove the necessity of injecting the heat carrier at a high pressure, which enables either eliminating or at least substantially reducing the probability of the steam finding its way into the drifts 1 (FIGS. 1 to 4).

The production of oil by a system of inclined and horizontal production wells 6 and 7 extending over considerable distances along the bed 4 permits employing to a better effect the natural fissured state of the bed 4, with the fissures extending predominantly vertically.

The spacing at each level of the production wells 6 and 7 and of the injection wells 8 is selected to correspond to the actual geological conditions. The spacing may be either uniform or varying.

The oil produced by the production wells 6 and 7 and supplied into the operation gallery 5 is directed from this operation gallery 5 into grooves or ditches provided in the drifts 1.

Jointly with water fed into the grooves or ditches, the oil is conveyed by gravity, owing to the inclination of the mine working of about 1°–3° to the horizontal plane, to units where it is separated from the main mass of the water. Alternatively, the oil with water may be conveyed along the drifts 1 by being pumped. From the above-mentioned units the oil is pumped into central underground oil reservoirs (not shown) wherefrom, following the pretreatment and heating, it is directed along pipelines either in the specifically provided wells or in the mine shaft into the reservoirs of oil storage facilities on the ground surface (the storage facilities are not shown).

The essence of the invention is unaffected if the drifts 1 (FIGS. 3 and 4) are provided below the oil-bearing bed. Moreover, with this arrangement of the drifts 1 the conditions of directing oil thereto from the operation galleries 5 are improved, because in this case the oil may be conveyed in a gravity flow.

The operation gallery 5 may be provided as a twin mine working, as shown in FIG. 3; or else it may be in the form of a single mine working, either rectilinear or curvilinear.

In both cases the extent of the operation gallery 5 is selected to satisfy the condition of dependable airing, in addition to other essential conditions. The ventilation system should comply with labour condition regulations and safety requirements.

In other embodiments of the present invention described hereinbelow there will be shown as illustrations vertical sectional views wherein the operation gallery includes a single mine working, although it should be understood that they may include, whenever necessary, twin mine workings.

It should be also understood that the drifts may extent both above and below the oil-bearing bed, if not specifically mentioned otherwise.

In the embodiments of the realization of the herein disclosed method, described hereinbelow, the system of collecting the oil, pretreating it and directing to the ground surface is understood to be similar to the above-described example of the method, where three operation galleries are accommodated within the oil-bearing bed.

Figure 5:
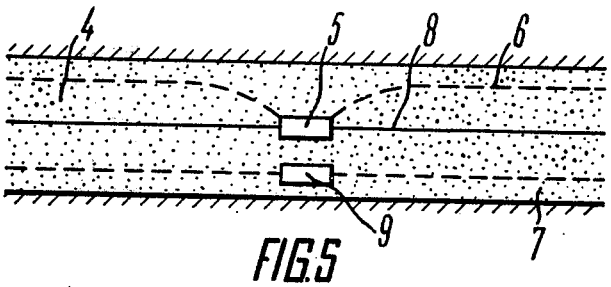
FIG. 5 is a vertical sectional view of the oil-bearing bed accommodating operation galleries in the central and lower portions thereof.

In another example of the realization of the disclosed method, where the upper portion of the oil-bearing bed 4 (FIG. 5) and the strata below it include incoherent and loose rock, and also where high-pressure water is present in the underlying strata, there are provided two operation galleries 5 and 9 of which one 5 is accommodated in the central portion of the oil-bearing bed 4, and rising production wells 6 and substantially horizontal injection wells 8 are drilled therefrom, the other gallery 9 being accommodated substantially in the area of the lower portion of the bed 4, and substantially horizontal production wells 7 are drilled therefrom.

The heat carrier is fed from the upper operation gallery 5 via the injection wells 8 extending over large distances along the oil-bearing bed 4, which permits to increase in the efficiency of the heating up of the oil-bearing bed.

The use of the two operation galleries 5 and 9 instead of three enables reduction in the volume of the costly mining work in the oil-bearing layer 4, and simplification of the operating of the production wells 6 drilled in the upper portion of the bed 4, owing to their upward inclination.

Figure 6:
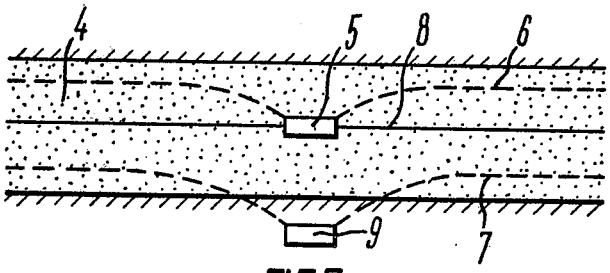
FIG. 6 is a vertical sectional view of the oil-bearing bed, with the operation galleries being arranged in the central portion of the bed and below it.

In another example, where the upper portion of the oil-bearing bed 4 (FIG. 5) includes incoherent and loose rock, while the central and lower portions of the bed 4 and the underlying strata are represented by good rock, the lower one 9 of the two galleries is provided below the oil-bearing bed, and rising production wells 7 (FIG. 6) are drilled therefrom.

The heat carrier is injected via the injection wells 8 from the upper operation gallery 5.

The upward inclination of the rising wells 6 and 7 provides for their operation by gravity flow, which significantly simplifies the oil production process.

The gravity flow also improves the operating conditions of the wells.

Figure 7:
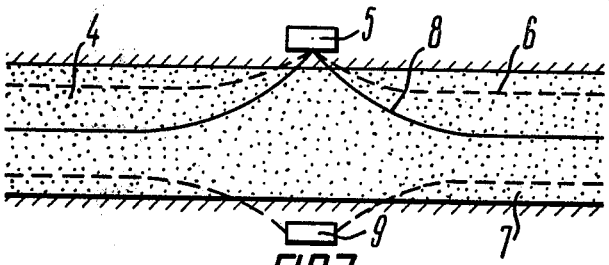
FIG. 7 is a vertical sectional view of the oil-bearing bed, with the operation galleries being arranged above and below it (the injection wells are drilled from the upper operation gallery)

When good rock is available both above and below the oil-bearing bed 4 (FIG. 7), and when the rock is harder in the upper portion of the oil-bearing bed 4 than in the lower portion thereof, the herein disclosed method may include the provision of two operation galleries of which one 5 is arranged above the oil-bearing bed 4, and inclined production wells 6 and injection wells 8 are drilled therefrom while the other operation gallery 9 is arranged below the oil-bearing bed 4, and rising production wells 7 are drilled therefrom.

Figure 8:
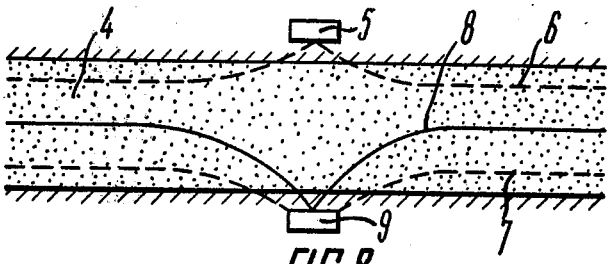
FIG. 8 is a vertical sectional view of the oil-bearing bed, with the operation galleries being arranged above and below it (the injection wells are drilled from the lower operation gallery)

With the rock being harder in the lower portion of the oil-bearing bed 4 (FIG. 8) than in the upper portion thereof, and with the presence of good rock both above and below the oil-bearing bed 4, the presently disclosed method may include providing also two operation galleries of which one 5 is arranged above the oil-bearing bed 4, and inclined production wells 6 are drilled therefrom, while the other gallery 9 is arranged below the oil-bearing bed 4, and rising production wells 7 and injection wells 8 are drilled therefrom.

The selection of the operation galleries 5 and 9 for drilling the injection wells 8 therefrom in the two above described examples (FIGS. 7 and 8) depends on the conditions enhancing the drilling of the injection wells 8 and providing for dependable ventilation in the mine workings where people work, as well as on the actual geological conditions.

Figure 9:
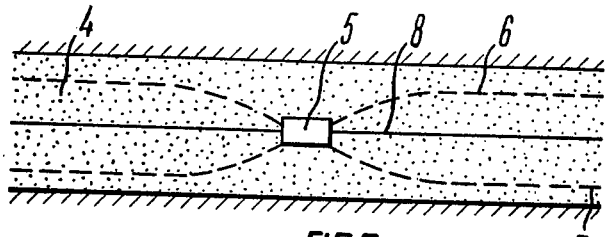
FIG. 9 is a vertical sectional view of the oil-bearing bed accommodating the operation gallery in the central portion thereof.

In oil-bearing beds 4 (FIG. 9) of relatively small thickness, made up of good and hard rock, the herein disclosed method may be effected by providing a single operation gallery 5 in the central portion of the oil-bearing bed 4 and drilling therefrom substantially horizontal injection wells 8 and rising and inclined production wells 6 and 7, respectively.

The reduction of the number of the operation galleries 5 to one enables reduction of the volume of costly mining work in the oil-bearing bed 4. The gallery 5 may be excavated by approaching it either from the upper portion of the oil-bearing bed 4, or from the lower portion thereof, which is determined by the actual mining and geological conditions, such as the hardness of the rock, the presence of gas therein, etc.

Figure 10:
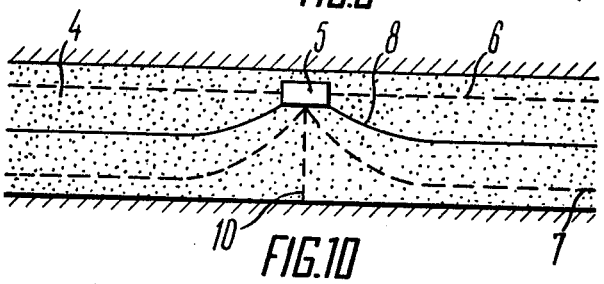
FIG. 10 is a vertical sectional view of the oil-bearing bed accommodating the operation gallery in the upper portion thereof.

In an example of the realization of the herein disclosed method, where both the central and lower portions of the oil-bearing bed 4 (FIG. 10) include incoherent and loose rock, the operation gallery 5 is provided substantially within the upper portion of the oil-bearing bed 4, and inclined injection wells 8 and substantially horizontal and inclined production wells 6 and 7, respectively, are drilled therefrom.

Since a "pillar" of oil is formed under the operation gallery, of which the development through the production wells 7 may take a long time, there are also drilled vertical production wells 10 from which oil is produced either by the free flow or by the air lift method.

Figure 11:
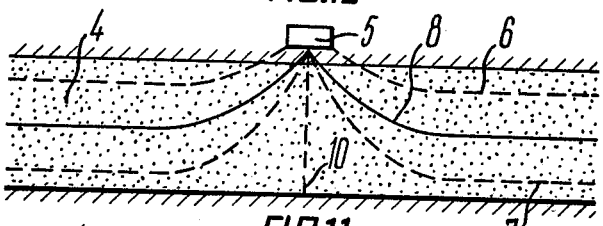
FIG. 11 is a vertical sectional view of the oil-bearing bed, with the operation gallery arranged above it.

In an example of the realization of the presently disclosed method, wherein the entire oil-bearing bed 4 (FIG. 11) is made up of incoherent and loose rock, with high-pressure water being present in the lower portion thereof, while good rock is available above the oil-bearing bed 4, a single operation gallery 5 is provided above the oil-bearing bed 4, and inclined production wells 6 and 7 and injection wells 8 are drilled therefrom. This permits the realization of the method under conditions where the entire oil-bearing bed 4 is made up of rock wherein the creation and maintenance in good order of mine workings is seriously impaired.

To produce oil from the "pillars" of the oil-bearing bed 4, underlying the operation gallery 5, specific vertical production wells 10 are drilled, from which oil is produced either by the free flow or by the air lift method.

Figure 12:
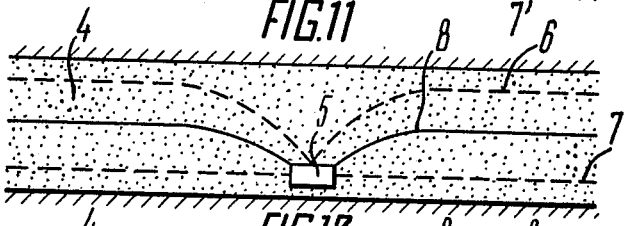
FIG. 12 is a vertical sectional view of the oil-bearing bed accommodating the operation gallery in the lower portion thereof.

Under conditions where the central and upper portions of the oil-bearing bed 4 (FIG. 12) include incoherent and loose rock, while the driving of mine workings above the oil-bearing bed is complicated, the presently disclosed method is effected by providing an operation gallery 5 substantially in the lower portion of the oil-bearing bed and drilling therefrom rising injection wells 8 and rising and substantially horizontal production wells 6 and 7, respectively.

Figure 13:
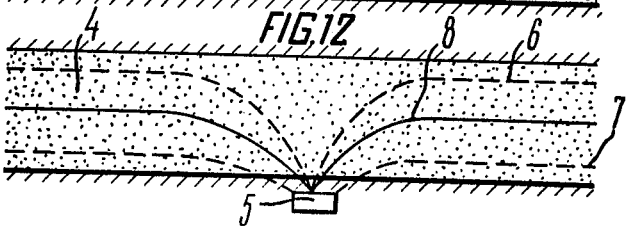
FIG. 13 is a vertical sectional view of the oil-bearing bed, with the operation gallery arranged below it.

Under conditions when both within the oil-bearing bed 4 (FIG. 13) and in the rock above it the provision of mine workings is either impossible or complicated, the herein disclosed method can be effected by providing an operation gallery 5 below the oil-bearing bed 4 and drilling therefrom rising production wells 6 and 7, respectively, and rising injection wells 8.

In this example there is no driving of mine workings within the oil-bearing bed 4.

Figure 14:
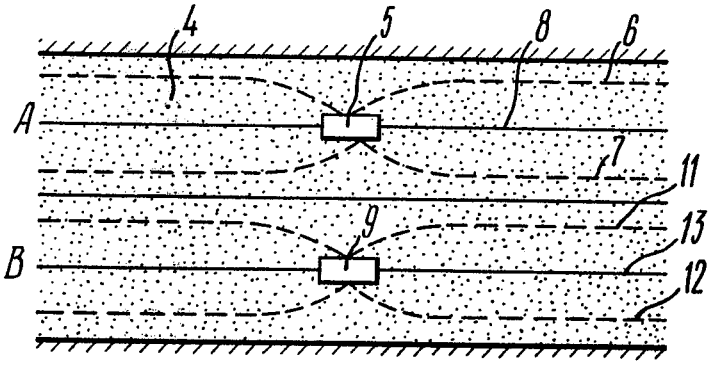
FIG. 14 is a vertical sectional view of an oil-bearing bed of a great thickness, subdivided into levels accommodating therein production and injection wells.

In an oil-bearing bed of a considerable thickness, such as the bed 4 in FIG. 14, the herein disclosed method is effected by subdividing the oil-bearing bed into several levels. In FIG. 14 there is illustrated the oil-bearing bed 4 subdivided into two levels A and B. Production wells 6, 7 and 11, 12 are drilled into the upper portions and lower portions, respectively, of the levels A and B, and the injection wells 8 and 13 are drilled, respectively, into the central portions of these levels.

Thus, in the upper level A (FIG. 14) from the operation gallery 5 there are drilled the injection wells 8 and the production wells 6 and 7, while in the lower level B from the operation gallery 9 there are drilled the injection wells 13 and the production wells 11 and 12.

The operation galleries are prepared using drifts extending either above or below the oil-bearing bed, depending on the actual geological conditions. When both above and below the oil-bearing bed the respective strata include good rock, the operation gallery 5 may be prepared from above, and the operation gallery 9 from below.

In a modification of the herein disclosed method, in an oil deposit wherein the oil displays no self-igniting tendency in the bed, following the heating up of the oil-bearing bed, air is used as the medium injected into the bed via the injection wells to force out the oil, the feed of the air being alternated with the feed of hot water and steam.

In accordance with this practical modification of the implementation of the present invention, the operations of feeding air, hot water and steam are carried out in the following optimized sequence.

1. Heating up the oil-bearing bed to a temperature at which the oil attains the required fluidity, as described above, for example by introducing a heat carrier through the injection and production wells into the oil bearing bead.

2. Charging compressed air into the oil-bearing bed which has been heated to a temperature at which the oil has attained the required fluidity via the injection wells.

The duration of the cycle of charging in the compressed air is determined by considering the physical properties of the oil and the geological characteristics of the oil-bearing bed, such as its thickness, porosity, the amount of fissures, oil- and water-saturation and other parameters.

The actual duration of the air-charging cycle may be from one to several days, the charging pressure being within a range, e.g. from 1 to 8 kgf/cm$^2$. The total volume of the charged-in air should not be above the figure that might result in self-ignition of the oil in the oil-bearing bed.

3. Charging hot water into the oil-bearing bed via the injection wells. The duration of the injection of hot water is from one to several days, the charging pressure being within a range, e.g. from 1 to 10 kgf/cm$^2$.

4. Charging steam into the oil-bearing bed via the injection wells. The duration of the steam-charging cycle depends on the geological and physical properties of the oil-bearing bed and may vary from 10 to 30 days. The charging pressure is within a range from 1 to 20 kgf/cm$^2$.

Oil is collected from the production wells likewise cyclically.

The successive cycles of charging in air, hot water and steam are repeated several times, according to the production schedule.

Upon entering the heated bed the air expands, creating an additional pressure drop across the bed, which enhances the motion of the oil toward the production wells. The oil is first forced out from large fissures and pores. Then the charged-in hot water forces out the oil from small pores and microfissures by capillary impregnation.

By selecting the amount of the actual heat carrier, e.g. steam and hot water at a level sufficient for maintaining the required temperature within the bed and by replacing that part of the charged-in heat carrier, which is used solely to collect the oil, i.e. to force it out from the oil bearing bed, with air, the efficiency of the oil-production process is improved, with less heat carrier being consumed per volume unit of oil produced.

The alternation of the injection into the preheated bed of air, hot water and steam enables cutting down the heat carrier consumption, and stepping up the rate of collecting oil from the bed, while maintaining the bed temperature at the level required by the production technology.

In another version of the implementation of the herein disclosed method, following the heating up of the bed, water-air mixture is used as the oil forcing-out medium positively fed into the bed via the injection wells, the feed of the water-air mixture being alternated with the feed of steam. According to this version of the implementation of the method in accordance with the present invention, the operations of charging in the water-air mixture and steam are effected in the following optimized sequence.

1. Heating up the oil-bearing bed to a temperature at which the oil attains the required fluidity, for example by introducing a heat carrier through the injection and production wells into the oil bearing bed.

2. Injecting or charging in the water-air mixture into the oil-bearing bed which has been heated to a temperature at which the oil has attained the required fluidity via the injection wells. The water to air ratio in the mixture, the duration of the charging cycle and the charging pressure are selected in accordance with the geological properties of the oil-bearing bed, such as its thickness, porosity, oil- and water-saturation and other parameters.

The actual duration of the water-air mixture charging cycle may be up to several days, the charging pressure being up to 8 kgf/cm$^2$. The water to air ratio in the mixture may vary within a broad range, e.g. up to several dozen cubic meters of water per 1000 m$^3$ of air.

3. Charging steam into the oil-bearing bed via the injection wells. The duration of the steam charging-in cycle may be from 10 to 30 days, with the charging pressure ranging from 1 to 20 kgf/cm$^2$.

Oil is collected from the production wells cyclically.

The cyclic sequence of charging the water-air mixture and steam into the oil-bearing bed is repeated several times, in accordance with the adopted production technology.

Upon entering the heated bed the water-air mixture expands. Thus, there is created an additional pressure drop across the bed, which enhances the motion of the oil toward the production wells. The pressure drop ousts the oil saturating the bed from large pores and fissures, while owing to capillary impregnation of the oil-bearing bed with the water of the water-air mixture, the oil is forced out from smaller pores and microfissures, the two processes taking place simultaneously.

The introduction into the injection cycle of the water-air mixture charging stage reduces the consumption of the heat carrier, the saved part being usable at new areas. The hot water produced by the production wells jointly with oil is preferably added into the air stream directed for preparing the water-air mixture. In this way the technology recovers the heat which would otherewise have been wasted in this accompanying water which previously was just pumped to the ground surface. This enhances still further the thermal efficiency of the process of exerting the steam-heat action upon the bed.

As a result of the implementation of the herein disclosed method, in addition to the reduction of the volume of the heat carrier injected into the bed, there are created conditions providing for maintaining a higher temperature in the bed for longer periods, which means that more forcing-out action is exerted upon the bed, whereby the latter's yield is stepped up.

It should be understood that the present invention may be used not less effectively for production of movable or fluent bitumens.

What is claimed is:

1. A method of thermal-mine oil production, which comprises providing a system of underground mine workings and at least one operation gallery;

drilling at least one production well from said operation gallery into at least one of the upper and lower portions of an oil-bearing bed;

drilling at least one injection well from said operation gallery into the central portion of the oil-bearing bed;

injecting a heat carrier through said injection and production wells into the oil-bearing bed to heat the latter to a temperature at which the oil attains the required fluidity within the oil-bearing bed;

injecting a heat carrier through said injection well into the central portion of the bed, for distributing the heat carrier uniformly through the volume of the oil-bearing bed and thus forcing the oil into said production well;

collecting the oil from the oil bearing bed through said production well in said operation gallery; and directing the oil from said operation gallery via the mine workings to the ground surface.

2. The method of claim 1, wherein two operation galleries are provided, of which one is accommodated in the central portion of the oil-bearing bed, rising production wells and substantially horizontal injection wells being drilled therefrom, the other said gallery being arranged below the oil-bearing bed, rising production wells being drilled therefrom.

3. The method of claim 1, wherein two operation galleries are provided, of which one is arranged above the oil-bearing bed, inclined injection and production wells being drilled therefrom, the other said gallery being arranged below the oil-bearing bed, rising production wells being drilled therefrom.

4. The method of claim 1, wherein two operation galleries are provided, of which one is arranged above the oil-bearing bed, inclined production wells being drilled therefrom, the other said gallery being arranged below the oil-bearing bed, rising production and injection wells being drilled therefrom.

5. The method of claim 1, wherein operation gallery is provided in the central portion of the oil-bearing bed, substantially horizontal injection wells and rising and inclined production wells being drilled therefrom.

6. The method of claim 1, wherein said operation gallery is provided substantially in the upper portion of the oil-bearing bed, inclined injection wells and inclined and substantially horizontal production wells being drilled therefrom.

7. The method of claim 1, wherein said operation gallery is provided above the oil-bearing bed, inclined production and injection wells being drilled therefrom.

8. The method of claim 1, wherein said operation gallery is provided substantially within the lower portion of the oil-bearing bed, rising injection wells and rising and substantially horizontal production wells being drilled therefrom.

9. The method of claim 1, wherein said operation gallery is provided below the oil-bearing bed, rising production and injection wells being drilled therefrom.

10. The method of claim 1, wherein, following the heating of the oil-bearing bed by the heat carrier to a temperature at which the oil attains the required fluidity, air is used as the heat carrier positively injected into the oil-bearing bed via said injection wells for forcing out the oil, the feed of the air being alternated with the feed of hot water and steam.

11. The method of claim 1, wherein, following the heating of the oil-bearing bed by the heat carrier to a temperature at which the oil attains the required fluidity, water-air mixture is sued as a heat carrier positively injected into the oil-bearing bed via said injection wells for forcing out the oil, the feed of the water-air mixture being alternated with the feed of steam.

12. The method of claim 1, wherein said oil-bearing bed is of considerable thickness and is divided into a plurality of levels, with an operation gallery in each level, and wherein each operation gallery is provided with production and injection wells, said production wells being drilled into the upper and lower part of each level and said injection well into the central portion of each level.

13. A method of thermal-mine oil production, which comprises:

providing a system of underground mine workings and three operation galleries, an upper gallery in the upper portion of an oil-bearing bed, a lower gallery in the lower portion of the oil-bearing bed, and a third gallery in the central portion of the oil-bearing bed;

drilling at least one substantially horizontal production well from each of the upper and lower galleries;

drilling at least one injection well from said third gallery into the central portion of the oil-bearing bed;

injecting a heat carrier through said injection and production wells into the oil-bearing bed to heat the latter to a temperature at which the oil attains the required fluidity within the oil-bearing bed;

injecting a heat carrier through said injection well into the central portion of the bed, for distributing the heat carrier uniformly throughout the volume of the oil-bearing bed and thus forcing the oil into said production wells;

collecting the oil from the oil bearing bed through said production wells; and directing the oil from said operation galleries via the mine workings to the ground surface.

14. A method of thermal-mine oil production, which comprises:

providing a system of underground mine workings and two operation galleries, a first gallery in the central portion of an oil-bearing bed, and the second gallery in the lower portion of the oil-bearing bed;

drilling at least one rising production well and at least substantially horizontal injection well from said first operation gallery;

drilling at least one horizontal production well and at least one rising production well from said second operation gallery;

injecting a heat carrier through said injection and production wells into the oil-bearing bed to heat the latter to a temperature at which the oil attains the required fluidity within the oil-bearing bed;

injecting a heat carrier through said injection well into the central portion of the bed, for distributig the heat carrier uniformly throughout the volume of the oil-bearing bed and thus forcing the oil into said production wells;

collecting the oil from the oil-bearing bed through said production wells; and directing the oil from said operation galleries via the mine workings to the ground surface.

* * * * *